US008528577B2

(12) United States Patent
Pietrzak et al.

(10) Patent No.: US 8,528,577 B2
(45) Date of Patent: Sep. 10, 2013

(54) SHOCK ABSORBING SYSTEM FOR TREKKING POLES

(75) Inventors: Christopher T. Pietrzak, Park City, UT (US); Ross M. Hinschberger, West Valley City, UT (US)

(73) Assignee: Easton Technical Products, Inc., Salt Lake City, UT (US)

( * ) Notice: Subject to any disclaimer, the term of this patent is extended or adjusted under 35 U.S.C. 154(b) by 72 days.

(21) Appl. No.: 12/835,544

(22) Filed: Jul. 13, 2010

(65) Prior Publication Data

US 2012/0012141 A1 Jan. 19, 2012

(51) Int. Cl.
*A45B 9/02* (2006.01)

(52) U.S. Cl.
USPC ..... 135/66; 135/76; 135/86

(58) Field of Classification Search
USPC ..... 135/66, 72, 76, 82, 86; 16/431, 16/436; 280/819, 821; 81/489
See application file for complete search history.

(56) References Cited

U.S. PATENT DOCUMENTS

| | | | | |
|---|---|---|---|---|
| 1,719,458 | A | 7/1929 | Visitacion | |
| 2,397,499 | A * | 4/1946 | McGowan | 135/82 |
| 3,158,162 | A | 11/1964 | Reel | |
| 3,556,544 | A * | 1/1971 | Hauser et al. | 280/823 |
| 4,061,347 | A | 12/1977 | Stern | |
| 4,244,602 | A * | 1/1981 | Allsop et al. | 280/821 |
| 4,357,013 | A | 11/1982 | Fernandez | |
| 4,362,322 | A * | 12/1982 | Schwarz | 280/821 |
| 4,537,399 | A | 8/1985 | Adam | |
| 4,609,198 | A | 9/1986 | Tarr | |
| 4,736,949 | A | 4/1988 | Muroi | |
| 4,907,810 | A | 3/1990 | Whiteford | |
| 5,114,186 | A | 5/1992 | Sugiyama | |
| 5,122,405 | A | 6/1992 | Landi | |
| 5,131,652 | A | 7/1992 | Peng | |
| 5,203,561 | A | 4/1993 | Lanctot | |
| 5,295,715 | A | 3/1994 | Van Blaricom | |
| 5,516,101 | A | 5/1996 | Peng | |
| 5,607,362 | A | 3/1997 | Haber | |
| 5,720,474 | A | 2/1998 | Sugiyama | |
| 6,131,592 | A * | 10/2000 | Panizza | 135/66 |
| 6,254,134 | B1 * | 7/2001 | Panizza | 280/819 |
| 6,763,747 | B1 * | 7/2004 | Gierer et al. | 81/489 |
| 6,898,824 | B2 | 5/2005 | Zaltron | |
| 6,916,035 | B2 | 7/2005 | Houser | |
| 7,229,101 | B2 * | 6/2007 | Lenhart | 280/819 |
| 7,270,138 | B2 * | 9/2007 | Liao | 135/82 |
| 7,611,449 | B2 * | 11/2009 | Kim | 482/110 |

(Continued)

FOREIGN PATENT DOCUMENTS

| | | | |
|---|---|---|---|
| DE | 3247161 | A1 | 6/1984 |
| EP | 304324 | B1 | 2/1992 |

(Continued)

*Primary Examiner* — Noah Chandler Hawk
(74) *Attorney, Agent, or Firm* — Holland & Hart

(57) ABSTRACT

A trekking pole assembly includes a trekking pole and a handle assembly mounted to the trekking pole. The handle assembly includes a handle housing with an interior cavity and a shock absorbing member secured within the interior cavity. The handle housing has a top end and a bottom end, an opening defined in the bottom end, and at least one lateral opening. The shock absorbing member is positioned in the handle housing and interposed between the handle housing and the trekking pole. A portion of the shock absorbing member is displaceable through the at least one lateral opening.

19 Claims, 10 Drawing Sheets

(56) References Cited

U.S. PATENT DOCUMENTS

| | | | | |
|---|---|---|---|---|
| 2001/0011817 | A1* | 8/2001 | Zaltron | 280/821 |
| 2002/0151377 | A1 | 10/2002 | Wu | |
| 2005/0150532 | A1* | 7/2005 | Lin | 135/75 |
| 2005/0255935 | A1 | 11/2005 | Yanagisawa | |
| 2008/0116682 | A1 | 5/2008 | Best et al. | |
| 2008/0235913 | A1 | 10/2008 | Eicher et al. | |
| 2009/0159107 | A1* | 6/2009 | Davenport | 135/82 |
| 2010/0170548 | A1 | 7/2010 | Lenhart | |

FOREIGN PATENT DOCUMENTS

| | | | |
|---|---|---|---|
| EP | 976428 | B1 | 6/2004 |
| EP | 1327468 | B1 | 12/2005 |
| GB | 2230458 | A | 10/1990 |

* cited by examiner

SHOCK ABSORBING SYSTEM FOR TREKKING POLES

TECHNICAL FIELD

The present disclosure relates generally to trekking poles, and more particularly to shock absorbing systems and methods for trekking poles.

BACKGROUND

Trekking poles have become increasingly popular for rigorous outdoor hiking as well as casual walkers. A hiker may use one or two trekking poles, each of which may act as a point of support to help balance and support the weight of the hiker's body while walking or hiking. A trekking pole of this type typically includes a handgrip designed for grasping by the user's hand, and an elongated member (e.g., pole or rod) extending from the handgrip at one end and terminating at some type of a point on the other end for contacting the ground.

Trekking poles with shock absorption capability have been used to absorb shock forces translated to the user's hand when using the trekking pole. Implementing a shock-absorbing system makes using the trekking pole generally more pleasant by absorbing part of the impact between the pole and the ground. Providing shock absorption in the trekking pole may reduce stress and strain on the user's body and enhance the trekking pole's functionality.

SUMMARY

One aspect of the present disclosure relates to a trekking pole assembly that includes a trekking pole and a handle assembly mounted to the trekking pole. The handle assembly includes a handle housing and a shock absorbing member. The handle housing has a top end, a bottom end, an interior cavity, an opening defined in the bottom end, and at least one lateral opening formed in the handle housing. The shock absorbing member is positioned in the interior cavity of the handle housing and interposed between the handle housing and the trekking pole. A portion of the shock absorbing member is at least partially displaceable through the at least one lateral opening.

The handle assembly may further include a handle cover mounted to an exterior of the handle housing. The trekking pole assembly may further include a plug inserted into an open proximal end of the trekking pole, the plug including a pin aperture, and an attachment pin that extends through the pin aperture and into the handle housing. The attachment pin may be configured to connect the plug to the handle housing.

The trekking pole assembly may further include a fastener, wherein the handle housing includes a housing pin aperture and a pin access opening, the attachment pin extends through the pin aperture and the housing pin aperture, and the fastener is insertable through the pin access opening and mounted to the attachment pin to retain the attachment pin to the handle housing.

The shock absorbing member may include a sleeve portion and an expandable portion. The sleeve portion may extend along at least a portion of a length of the trekking pole, and the expandable portion may be positioned between a proximal end of the trekking pole and the handle housing. The expandable portion may be configured to move through the at least one lateral opening in the handle housing upon relative longitudinal movement between the trekking pole and handle housing. The sleeve portion may include a plurality of longitudinally arranged ribs in contact with the trekking pole.

The handle housing may include a dividing wall that defines upper and lower cavities, and the shock absorbing member is positioned in the lower cavity. The handle housing may include a dividing wall that defines upper and lower cavities in the handle housing, wherein the housing pin aperture is defined in the dividing wall, and the at least one lateral opening is open to the lower cavity. The shock absorbing member may include a gel or semi-gel material.

Another aspect of the present disclosure relates to a handle shock absorbing system that includes a handle member and a shock absorbing member. The handle member includes a first open end, a second closed end, and a plurality of lateral openings. The shock absorbing member is positioned in the handle member and is configured to expand out of at least one of the lateral openings upon application of a longitudinal force to the shock absorbing member.

The handle shock absorbing system may further include an attachment pin configured to connect the handle member to a trekking pole. The attachment pin may extend through a pin aperture in the handle member and through the shock absorbing member. The handle shock absorbing system may also include a plug insertable into the trekking pole, wherein the attachment pin extends through the plug and through a pin aperture of the handle member.

A further aspect of the present disclosure relates to a method of absorbing shock forces in a trekking pole assembly. The method includes providing a trekking pole assembly having a trekking pole and a handle assembly mounted to the trekking pole, wherein the handle assembly includes a handle housing and a shock absorbing member interposed between the handle housing and the trekking pole. The handle housing includes at least one expansion cavity. The method further includes longitudinally moving the trekking pole toward the handle assembly to create a shock force, and moving a portion of the shock absorbing member into the at least one expansion cavity in a first direction to absorb at least some of the shock force.

The method may also include longitudinally moving the trekking pole away from the handle assembly, and moving the portion of the shock absorbing member out of the at least one expansion cavity in a second direction that is opposite the first direction. The at least one expansion cavity may include first and second lateral openings through the handle housing, wherein moving a portion of the shock absorbing member includes moving separate portions of the shock absorbing member in opposite directions through the first and second lateral openings.

The method may also include coupling the handle assembly to the trekking pole with an attachment pin, wherein the attachment pin extends through a pin aperture in the handle housing, through the shock absorbing member, and through a plug mounted at a proximal end of the trekking pole. The shock absorbing member may include an expandable portion and a sleeve portion, wherein the sleeve portion extends along an exterior of the trekking pole along a portion of a length of the trekking pole, and the expandable portion is interposed between an end surface of the trekking pole and the handle housing. Moving a portion of the shock absorbing member may include expanding the expandable portion into the at least one expansion cavity. The method may also include rotating the handle assembly relative to the trekking pole to absorb shock or vibrational forces in the trekking pole assembly.

Features from any of the above-mentioned embodiments may be used in combination with one another in accordance with the general principles described herein. These and other embodiments, features, and advantages will be more fully understood upon reading the following detailed description in conjunction with the accompanying drawings and claims.

BRIEF DESCRIPTION OF THE DRAWINGS

The accompanying drawings illustrate a number of exemplary embodiments and are a part of the specification. Together with the following description, these drawings demonstrate and explain various principles of the instant disclosure.

Figure 1:
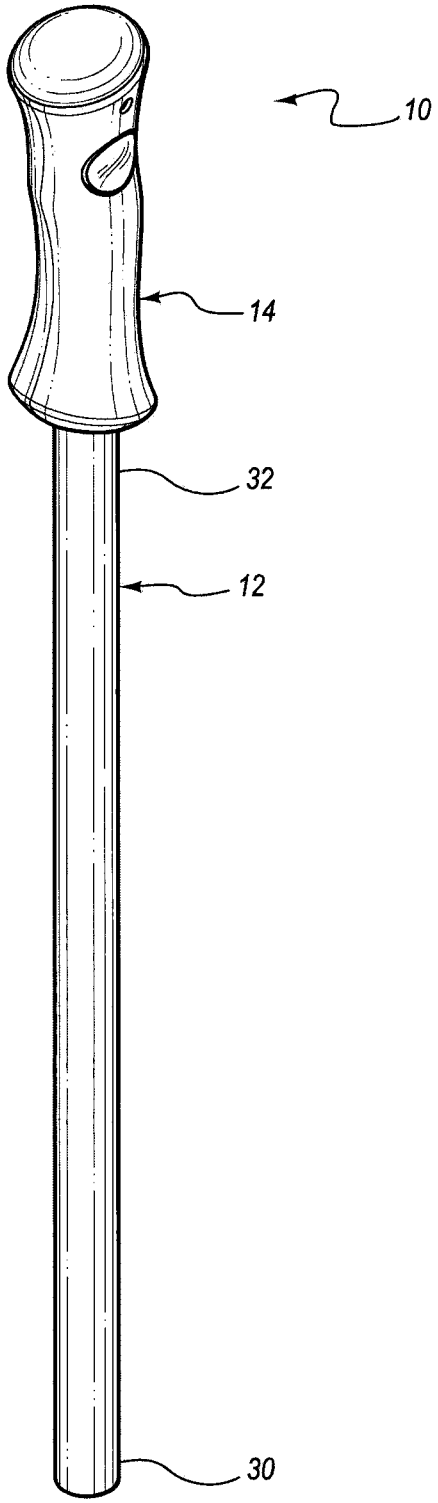
FIG. 1 is a perspective view of an example trekking pole assembly in accordance with the present disclosure.
Figure 2:
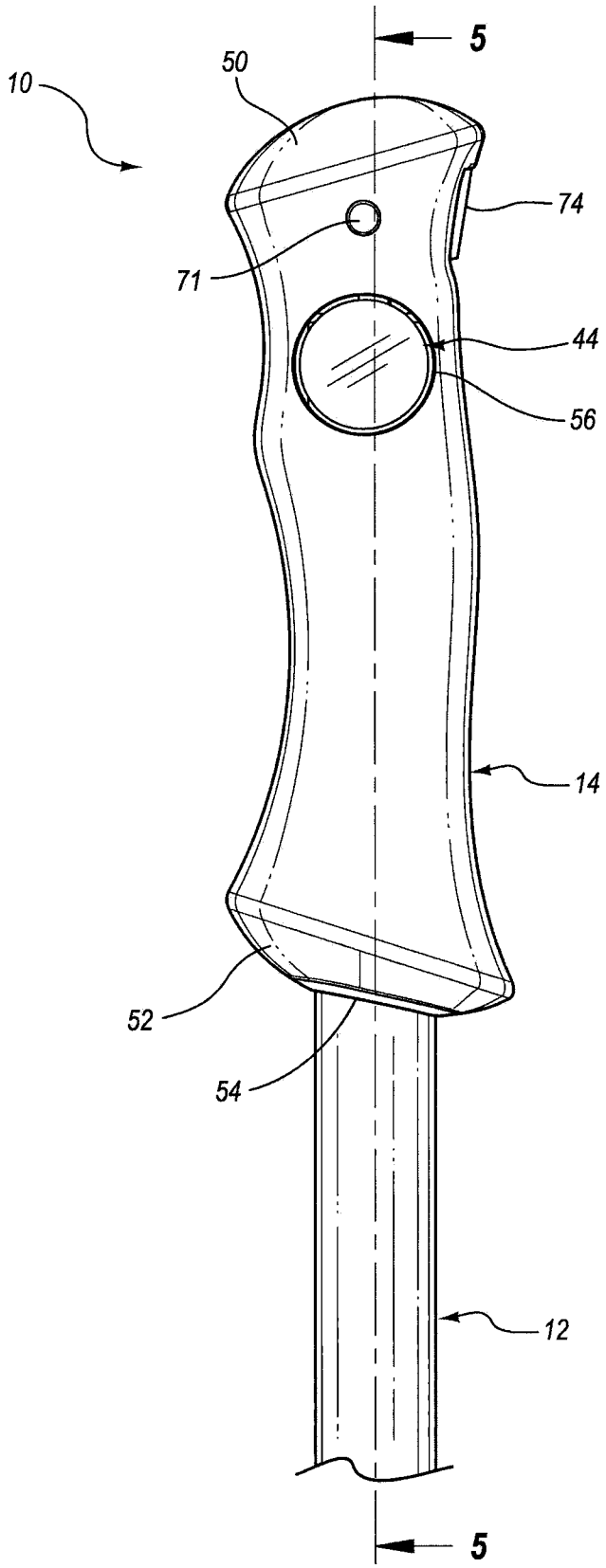
FIG. 2 is a right side view of the trekking pole assembly of FIG. 1.
Figure 3:
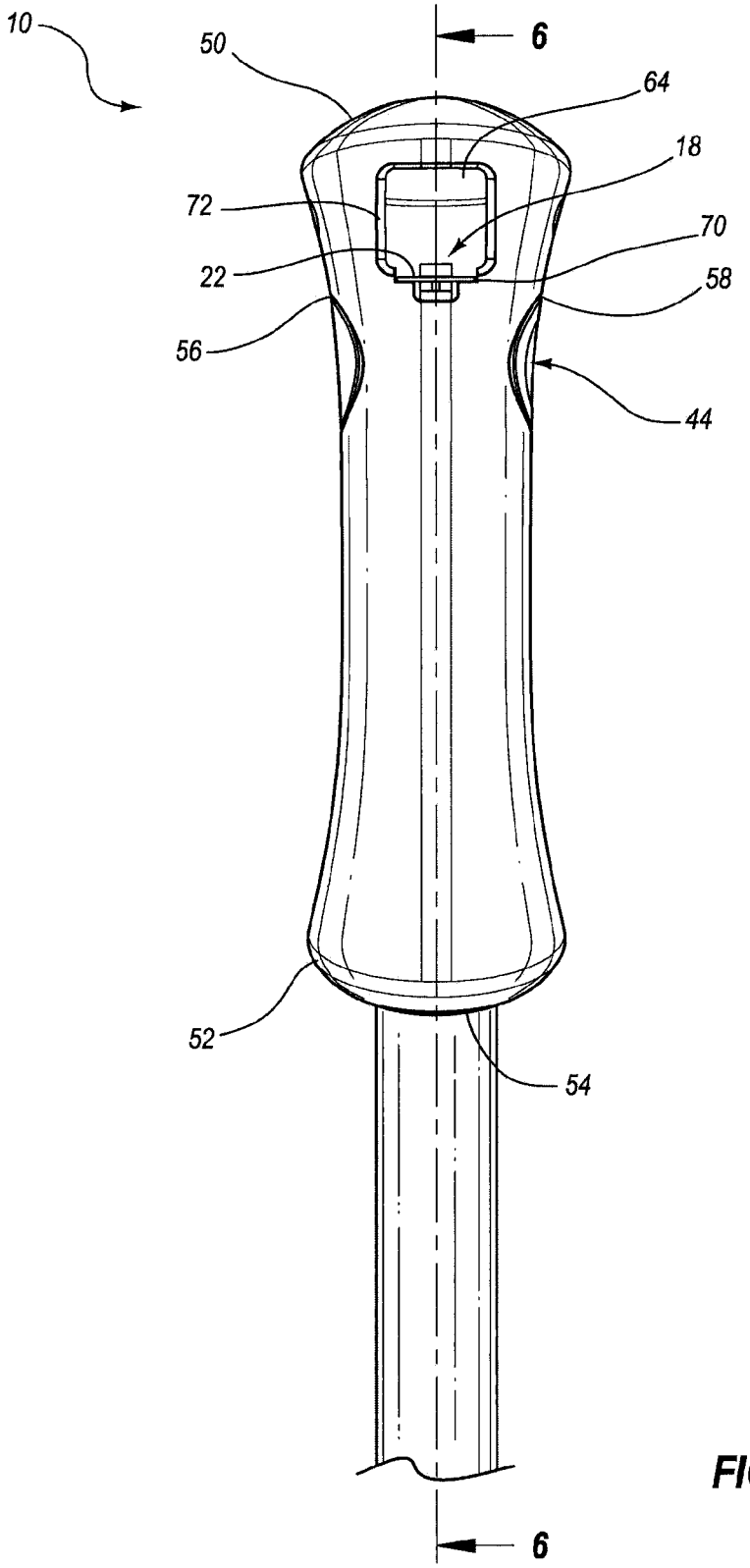
FIG. 3 is a front view of the trekking pole assembly of FIG. 1.

Throughout the drawings, identical reference characters and descriptions indicate similar, but not necessarily identical, elements. While the exemplary embodiments described herein are susceptible to various modifications and alternative forms, specific embodiments have been shown by way of example in the drawings and will be described in detail herein. However, one of skill in the art will understand that the exemplary embodiments described herein are not intended to be limited to the particular forms disclosed. Rather, the instant disclosure covers all modifications, equivalents, and alternatives falling within the scope defined by the appended claims.

DETAILED DESCRIPTION

The present application is directed to shock absorbing systems, and in particular shock absorbing members for a handgrip or handle assembly. Although the shock absorbing system shown in the drawings relate to trekking pole systems, the shock absorbing system for a handle assembly may form part of any number of other devices such as, for example, ski poles, sports rackets, hockey sticks, and other devices that include a handle mounted to the device. The shock absorbing system may be particularly useful for dissipating shock forces applied to an elongated device with a handle. The shock forces to be dampened may be translated from one end of the elongated device to another. The shock absorbing handle or handgrip may also provide shock absorption and dissipation of vibrational forces translated in other directions such as rotationally and laterally.

In one example, the shock absorbing system may include a shock absorbing member such as a gel insert or liner that is interposed between a housing of the handgrip and an end of the elongated member (i.e., a shaft or pole member of a trekking pole, ski pole or sports racket) to which the handgrip is mounted. The handle housing may include at least one opening or aperture that permits expansion of the shock absorbing member upon application of shock forces that compress the shock absorbing member. The opening or aperture may extend to an outer surface of the handle housing so that at least a portion of the shock absorbing member is visible and/or exposed outside the handle housing. In at least one example, the handle housing includes two lateral openings and the shock absorbing member expands through the two lateral openings upon application of a longitudinal shock force to the shock absorbing member.

The shock absorbing member may include a sleeve portion that extends along at least a portion of a length of the elongated structure (e.g., shaft or pole) to which the handgrip is mounted. The sleeve portion may allow some relative rotation and axial displacement between the handgrip and the elongated device. The sleeve portion may include a plurality of ribs that define an interface between the sleeve portion and the elongated member. In at least some arrangements, the ribs provide a reduced surface contact area between the shock absorbing member and the elongated member.

The handgrip may be connected to the elongated member of the device using an attachment pin. The attachment pin may extend from the elongated member, through at least a portion of the shock absorbing member, and may be attached to a portion of the handgrip housing. The attachment pin may be connected to the elongated member via a plug or cap that is mounted to an end of the elongated member. The attachment pin may provide a releasable connection between the handgrip housing and the elongated member to permit replacement/or repair of the handgrip housing.

The shock absorbing member may include different types of shock absorbing material, and may include a combination of different materials. The shock absorbing member may have different sizes and shapes for use with different devices and associated applications to provide variable amounts and varying degrees of shock absorption. Providing variable amounts of shock absorption at the handgrip may help users customize their elongated devices for different activities that impose different amounts and types of shock or vibration forces in the device.

Referring now to FIGS. 1-12, an example trekking pole assembly 10 is shown and described. The trekking pole assembly 10 includes a pole 12, a handle assembly 14, a plug 16, an attachment pin 18, a pole insert 20, and a clip 22 (see FIGS. 4-7). The pole 12 includes distal and proximal ends 30, 32, respectively, and a hollow interior 34. The pole insert 20 may be inserted into the hollow core 34 of the pole 12 near the proximal end 32. The pole insert 20 may help strengthen and provide additional rigidity at the proximal end 32 where the handle assembly 14 is mounted to the pole 12. The plug 16 may be mounted to the proximal end 32 by inserting at least a portion of the plug 16 into the hollow core 34. Other structures, such as a cap structure or a combination plug and cap structure, that at least partially extend along an exterior surface of the pole 12 may be used in place of the plug 16.

The handle assembly 14 is mounted to the pole 12 at the proximal end 32. The attachment pin 18 may be inserted through the distal end 30 of the pole 12, through the plug 16, and into the handle assembly 14. The clip 22 may be secured to the attachment pin 18 within the handle assembly 14 to maintain the attachment pin 18 connected to the handle assembly 14.

The handle assembly 14 may include a handle or handgrip housing 40, a handle cover 42, and a shock absorbing member 44. The shock absorbing member 44 may also be referred to herein as a gel member, a liner, a shock absorbing gel, or a shock absorbing liner. The shock absorbing member 44 may comprise material having enhanced shock and vibration absorption properties. Any suitable elastomeric rubber or similar material may be used. Some example materials for shock absorbing member 44 may include Narcom™, silicon gel, fluid, and air.

Figure 4:
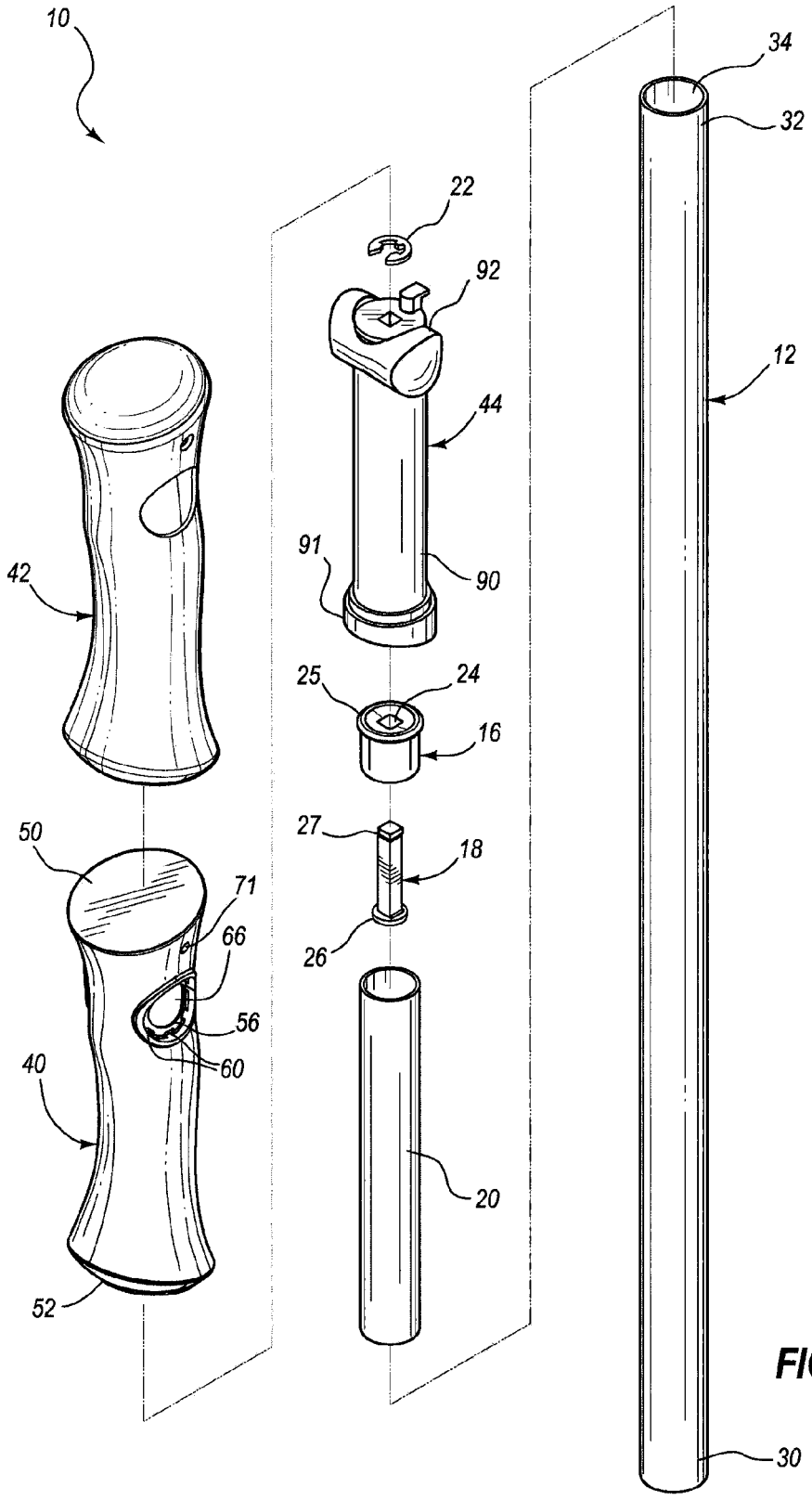
FIG. 4 is an exploded perspective view of the trekking pole assembly of FIG. 1.
Figure 5:
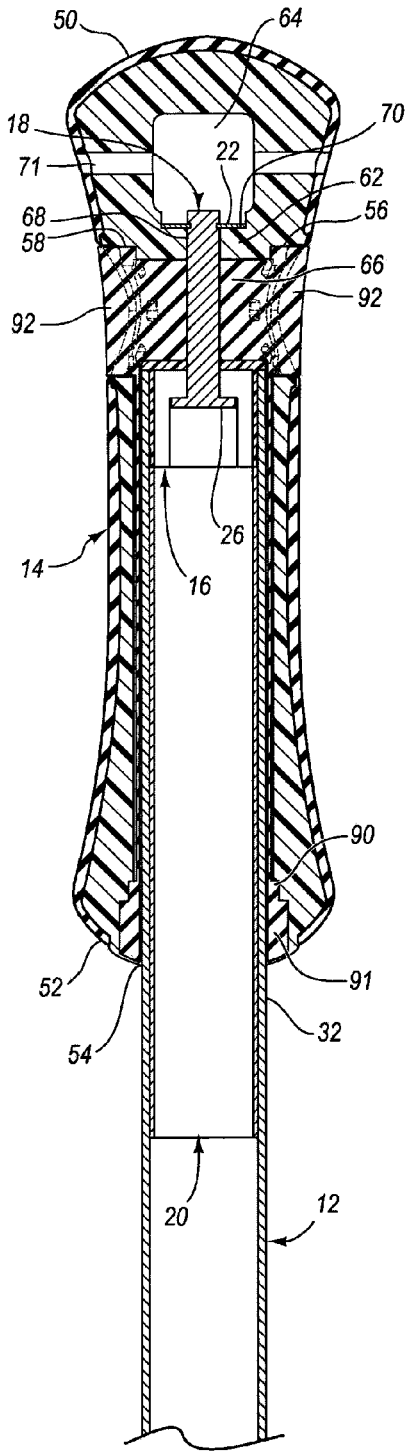
FIG. 5 is a cross-sectional view of the trekking pole assembly of FIG. 2 taken along cross-section indicators 5-5.
Figure 6:
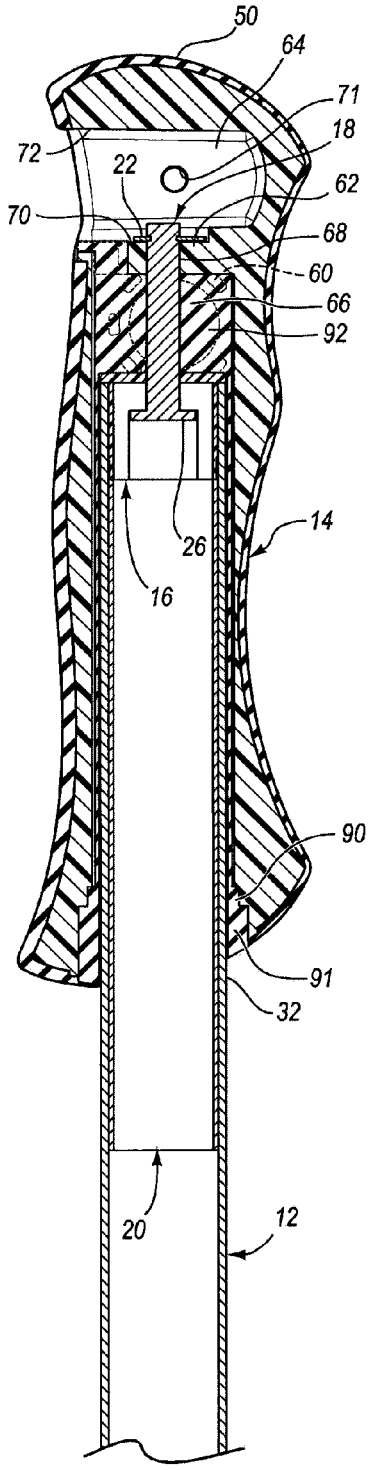
FIG. 6 is a cross-sectional view of the trekking pole assembly of FIG. 3 taken along cross-section indicators 6-6.

The handgrip housing 40 includes upper and lower ends 50, 52, a bottom opening 54, first and second lateral openings 56, 58 having a plurality of flow through lateral apertures 60, and a dividing wall 62 that separates an interior of the handle housing 40 into respective upper and lower cavities 64, 66 (see FIGS. 4-6). The dividing wall 62 includes a pin aperture 68 sized to receive the attachment pin 18. The dividing wall 62 may also define a clip seat 70 sized to receive the clip 22. The handle housing 40 may also include a lateral pin access opening 72 that provides an opening into the upper cavity 64 for insertion of the clip 22, wherein the clip 22 is connected to the attachment pin 18. An opening cover 74 may be mounted to the handle housing 40 to enclose the upper cavity 64 and substantially cover the lateral pin access opening 72 (see FIGS. 2 and 4).

The dividing wall 62 may completely separate the upper and lower cavities 64, 66. In some arrangements, the dividing wall 62 may include a plurality of openings that permit some expansion of the shock absorbing member 44 into the upper cavity 64.

As shown in FIG. 4, the handle cover 42 may optionally be used in connection with the shock absorbing system. The handle cover 42 may include a plurality of openings that may be aligned with the various openings of the handle housing 40, such as, for example, the first and second lateral openings 56, 58, the lateral pin access opening 72, and the bottom opening 54. The handle cover 42 may comprise an improved gripping material that enhances a connection between the user's hand and the handle assembly 14. The handle cover 42 may comprise material such as, for example, cork, rubber, plastic, wood, and metal. In some arrangements, the handle cover 42 may be integrally formed with the handle housing 40 using, for example, a co-molding process. In other arrangements, the material of the handle housing 40 may provide a desired amount of gripping by the user, thus eliminating the need for the handle cover 42.

A hole 71 (FIGS. 2 and 4-7) may be defined through the handle housing 40 and handle cover 42. The hole 71 may be sized for inserting a pin (not shown) to which a wrist webbing (not shown) may be attached. The hole 71 may extend into the upper cavity 64. The wrist webbing may be used to secure the trekking pole assembly 10 to the user's wrist. In some arrangements, at least portions of the wrist webbing may extend through the hole 71 to directly secure the wrist webbing to at least one of the handle housing 40 and handle cover 42.

Figure 7:
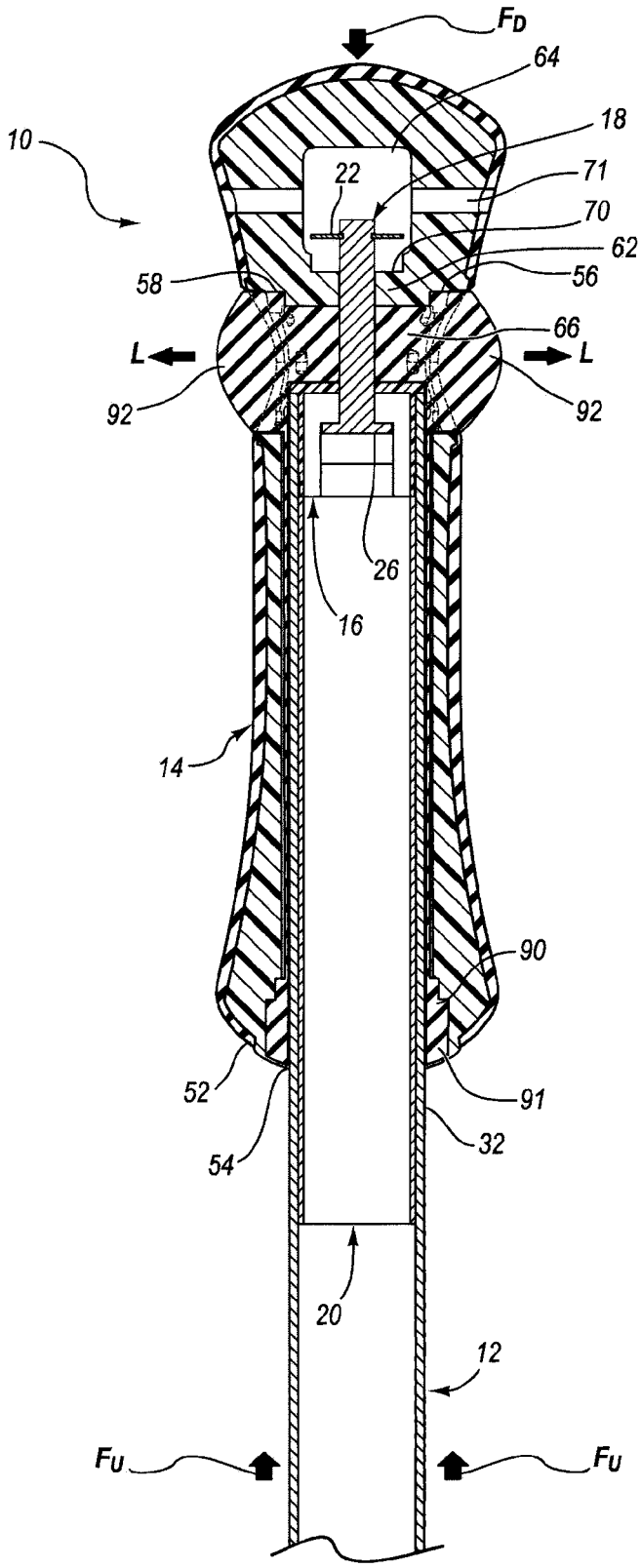
FIG. 7 shows the cross-sectional view of FIG. 5 with the handle assembly moved relative to the pole.
Figure 8:
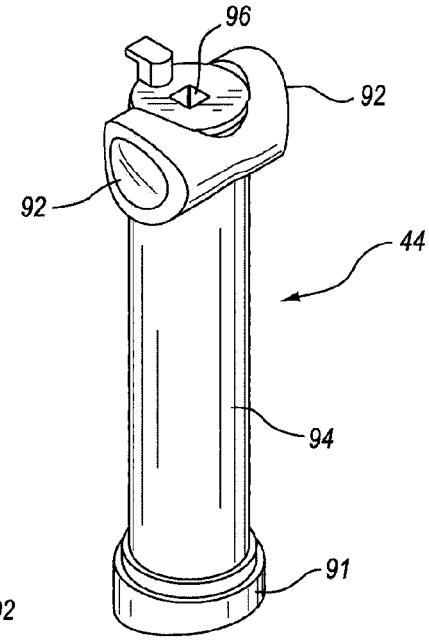
FIG. 8 is a perspective view of a shock absorbing member of the handle assembly show in FIGS. 1-7.
Figure 9:
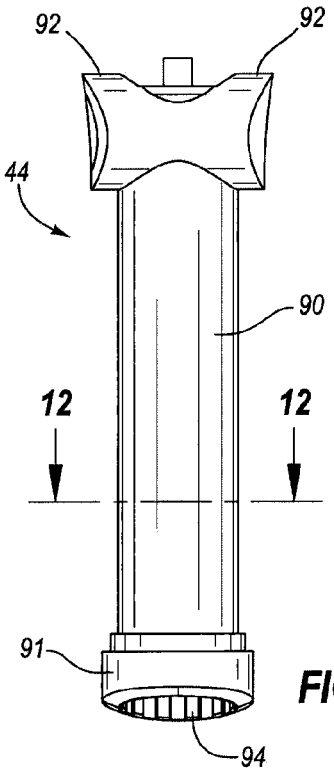
FIG. 9 is a rear view of the shock absorbing member of FIG. 8.
Figure 10:
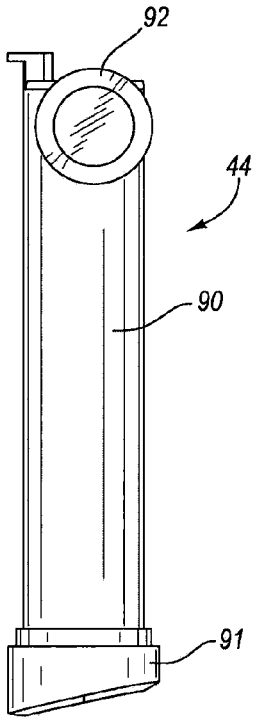
FIG. 10 is a side view of the shock absorbing member of FIG. 8.
Figure 11:
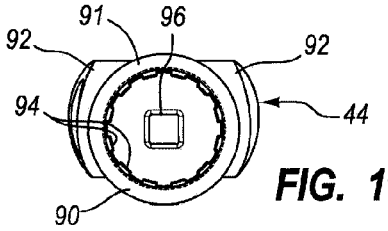
FIG. 11 is a bottom view of the shock absorbing member of FIG. 8.
Figure 12:
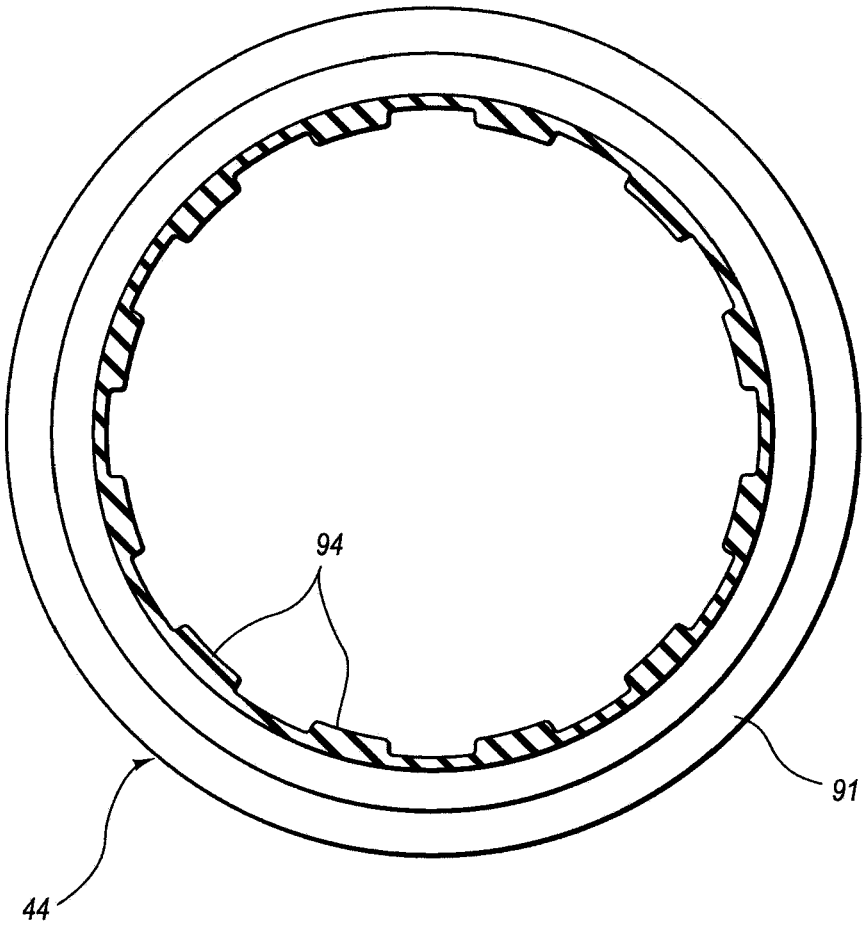
FIG. 12 is a cross-sectional view of the shock absorbing member of FIG. 9 taken along cross-section indicators 12-12.

Referring now to FIGS. 8-12, the shock absorbing member 44 may comprise a sleeve portion 90, a pair of opposed expandable portions 92, a plurality of rib members 94, and a pin aperture 96. The expandable portion 92 may be configured to expand laterally or radially outward relative to the sleeve portion 90. The expandable portion 92 may be positioned at a proximal end surface of the proximal end 32 of the pole 12 (see FIG. 7). The expandable portion 92 may be interposed inside an interior cavity of the handle housing 40, with the sleeve portion 90 inserted over proximal end 32 of the pole 12. As shown in FIGS. 5-7, the expandable portion 92 has a thickness that is substantially greater than a thickness of the sleeve portion.

The sleeve portion 90 may be configured to extend around a periphery of the pole 12 along at least a portion of a length of the pole 12. Specifically, the sleeve portion 90 may be interposed between the pole 12 (along the length of the pole 12) and the handle housing 40 within the lower cavity 66. The sleeve portion 90 may include an increased thickness portion 91 at an end of the shock absorbing member 44 opposite the expandable portion 92. The sleeve portion 90 may include a plurality of interior rib numbers 94 (FIGS. 9, 11, and 12) extending along a length thereof in a longitudinal orientation. The rib members 94 may define a reduced surface contact area between the shock absorbing member 44 and the outer peripheral surfaces of the pole 12 along a portion of the length of pole 12. The rib members 94 may enhance relative movement between the handgrip housing 40 and the pole 12 for torsional shock absorption. In at least some arrangements, the rib members 94 may also promote longitudinal movement between the handgrip housing 40 and the pole 12.

The increased thickness portion 91, along with other portions of the sleeve portion 90, may assist in dissipating shock forces (e.g., longitudinal impact forces, torsional forces, and vibrational forces) between the pole 12 to the handle assembly 14. The increased thickness portion 91 may be effective in dissipating forces as they travel up the pole 12 from the distal end 30 toward the proximal end 32 as such forces first reach the handle assembly 14 at the lower end 52 of the handle housing 40.

The shock absorbing member 44 may be constructed as a single unitary piece. In at least one example, the shock absorbing member 44 may be injection molded into the lower cavity 66 of the handle housing 40. The material used to form the shock absorbing member 44 may flow through the flow through lateral apertures 60 of the handle housing 40 to create additional lateral flow paths for the shock absorbing member 44 to move relative to the handle housing 40. The multiple flow paths for material of the shock absorbing member 44 include both the first and second lateral openings 56, 58 and the flow through lateral aperture 60, which may also assist in permitting the expandable portion 92 to return to its original shape (see FIG. 5) after having expanded out through the openings 56, 58, 60 when longitudinal forces are applied (see FIG. 7).

The first and second lateral openings 56, 58 may be constructed as expansion cavities in communication with the interior lower cavity 66 and extend to openings in an outer surface of the handgrip housing 40. Portions of the shock absorbing member 44 may move into and out of, or through, the expansion cavities defined by the first and second lateral openings 56, 58.

Referring now to FIG. 7, when a longitudinally impact force is applied to the handle assembly 14 in a downward direction ($F_D$) toward the pole 12, or a longitudinally directed force is applied to the pole in the upward direction ($F_U$) toward the handle assembly 14, the pole 12 moves relative to the handgrip housing 40 to compress a portion of the shock absorbing member 44 in a longitudinal or upward direction. FIG. 7 illustrates the expandable portion 92 of the shock absorbing member 44 expanding radially or laterally in a direction L as the proximal end 32 of the pole 12 moves longitudinally relative to the handle housing 40. The plug 16 may provide additional surface contact area along the proximal end 32 of the pole 12 that contacts the expandable portion 92 of the shock absorbing member 44.

The expandable portion 92 may be forced out of the space now occupied by the proximal end 32 of the pole 12. Due to the shape and size of the upper cavity 64, which is defined at least in part by the dividing wall 62, the expandable portion 92 will tend to move into any open space (e.g., laterally) inside or outside of the housing handle 40. The first and second lateral openings 56, 58 and the flow through lateral aperture 60 provide pathways for portions of the expandable portion 92 to move or expand as the pole 12 moves longitudinally further towards the dividing wall 62.

While the handgrip housing 40 of the present embodiment includes first and second lateral openings 56, 58 that expose portions of the shock absorbing member 44 at exterior surface locations along the handle assembly 14, other embodiments may provide an interior space or cavity enclosed within the handle assembly 14 within which the shock absorbing member 44 may expand as the pole 12 moves relative to the handgrip housing 40. The cavity or space in the handgrip housing 40 within which the shock absorbing member 44 expands may be arranged in any direction relative to the longitudinal movement of the pole 12 relative to the handle assembly 14.

Referring again to FIGS. 4 and 7, as the pole 12 moves toward the handle assembly 14 longitudinally, the attachment pin 18 may move further longitudinally into the upper cavity 64. The attachment pin 18 may move relative to the handgrip housing 40 without being disconnected from the handgrip housing 40. The attachment pin 18 includes a head 26 retained against the plug 16, and a clip recess 27 that receives the clip 22 to limit longitudinal motion of the attachment pin 18 relative to the pole 12 and handle assembly 14. The clip 22 may be removable from the clip recess 27 to permit disassembly of the handle assembly 14 from the pole 12. Other fasteners besides attachment pin 18 and clip 22 may be used to releaseably or permanently secure the attachment pin 18 to the pole 12 and handle assembly 14.

The attachment pin 18 may be circular in cross-section, or may have a polygonal (e.g., rectangular) or other noncircular cross-section along at least a portion of its length. A pin aperture 24 of the plug 16 (discussed below), the pin aperture 96 of the shock absorbing member 44, and the pin aperture 68 of the handgrip housing 40 may be sized and shaped to correspond to the cross-sectional size and shape of the attachment pin 18. A mating relationship between the pin apertures 24, 96, 68 and the attachment pin 18 may limit relative rotation between the attachment pin 18, plug 16, shock absorbing member 44, and handgrip housing 40.

The plug 16 may include a pin aperture 24 through which the attachment pin 18 is inserted. The plug 16 may also include a rim or cap 25 that defines at least in part a surface against which the pole 12 contacts the expandable portion 92 of the shock absorbing member 44. The cap 25 may also define a surface against which the head 26 of the attachment pin 18 contacts to retain the attachment pin 18 to the pole 12.

In other arrangements, the plug 16 may be sized to fit over an exterior surface of the pole 12 rather than being inserted into the hollow core 34. In some arrangements, the plug 16 may extend completely within the hollow core 34. The plug 16 may be secured to the pole 12 with, for example, an interference fit. Other connection features and arrangements may be used to secure the plug 16 to the pole 12 such as, for example, fasteners, snap-fit features, adhesives, or other connecting methods and structures. Similarly, the attachment pin 18 may include various features and constructions that secure the attachment pin 18 to either or both of the pole 12 and handle assembly 14. In at least one example, the attachment pin 18 extends downward from the handle assembly 14 into plug 16 and is secured to the plug 16 with a snap-fit or other connection.

The bulging or expanding of the expandable portion 92 through the first and second lateral openings 56, 58 to an outer surface of the handle housing 40 may provide a tactile or visual confirmation to the user that the trekking pole assembly 10 is absorbing shock forces exerted between the pole 12 and handle assembly 14. In some arrangements, the handgrip housing 40 may include only a single lateral opening or three or more lateral openings that provide a pathway for at least a portion of the shock absorbing member 44 to expand or otherwise move during relative longitudinal movement between the pole 12 and handle assembly 14. In some examples, the expandable portion is positioned along the length of the sleeve portion at a location spaced distal of the proximal end 32 of the pole when in a rest state.

The openings or pathways in the handle housing 40 through which the shock absorbing member 44 expands as part of absorbing shock, vibration, or other forces between the pole 12 and handle assembly 14 may be arranged at any angle, including an angle that may not be directly radial or lateral as is shown in the figures. Any pathway or opening in the handle assembly 14 that permits expansion of a portion of the shock absorbing member 44 during relative movement of the pole 12 and handle assembly 14, whether exposed along an exterior surface of the handle assembly 14 or concealed within the handle assembly 14, may enhance the ability of the shock absorbing member 44 to perform its intended function of absorbing forces.

The sleeve portion 90 and expandable portion 92 of the shock absorbing member 44 may be integrally formed as a single piece. In other arrangements, the sleeve portion 90 and expandable portion 92 may be formed as separate pieces that may be separately assembled with the handle housing 40. In some arrangements, the shock absorbing member 44 may include only one of the sleeve portion 90 and expandable portion 92.

The first and second lateral openings 56, 58 may be arranged along the handle housing 40 at any longitudinal location relative to dividing wall 62. In the illustrated embodiment, the first and second lateral openings 56, 58 are positioned adjacent to the dividing wall 62 and proximal of the proximal end 32 of pole 12 prior to the forces $F_D$, $F_U$ being applied (i.e., a rest state). In other arrangements, the lateral openings in the handle housing 40 may be positioned distal of the proximal end 32 when the trekking pole assembly is in a rest state.

Many features of the handle assembly 14 may help contribute to the shock absorbing capability of the handle assembly 14. For example, the materials for the shock absorbing member 44, the position of the shock absorbing member 44 interposed between the pole 12 and handle housing 40, the construction of the shock absorbing member 44 (e.g., the sleeve portion 90, the expandable portion 92, the rib members 94, and the increased thickness portion 91, individually or in any combination), connection of the handle assembly 14 to the pole 12 using the plug 16 and slidable attachment pin 18, and the construction of the handgrip housing 40 to permit expansion of the shock absorbing member 44 (i.e., the lateral openings 56, 58 of the handle housing 40) each individually, or in some combination, provide improved shock absorption capability for a device (e.g., trekking pole assembly) that includes the handle assembly 14.

Figure 13A:
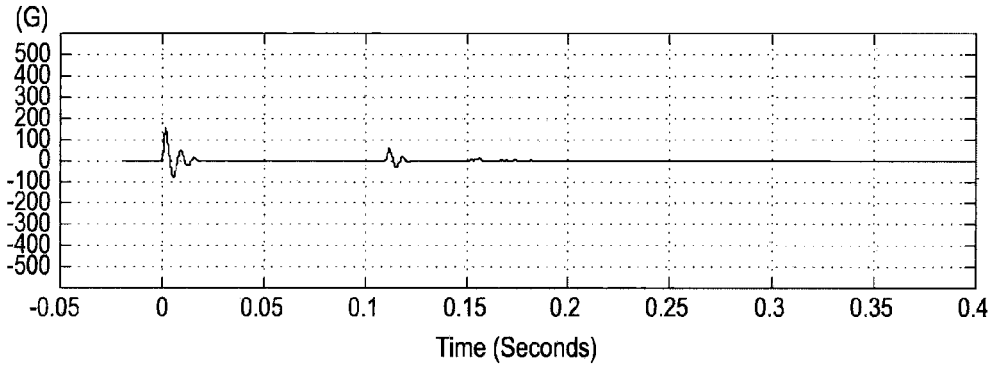
FIG. 13A is a graph illustrating shock absorption data for the trekking pole assembly of FIGS. 1-12 resulting from a drop test.
Figure 13B:
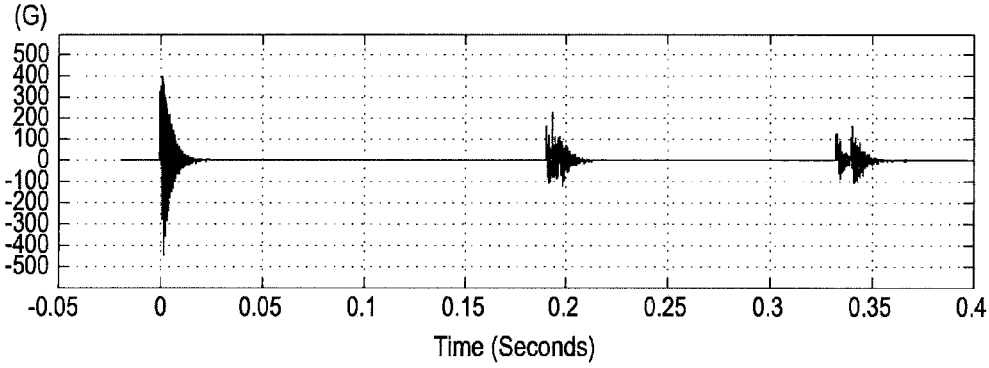
FIG. 13B is a graph illustrating shock absorption data for a trekking pole assembly without any shock absorbing system resulting from a drop test.
Figure 14A:
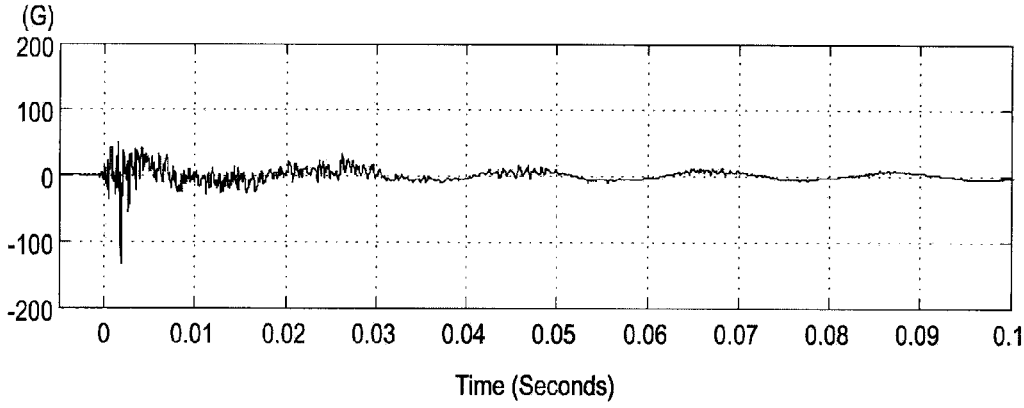
FIG. 14A is a graph illustrating shock absorption data for the trekking pole assembly of FIGS. 1-12 resulting from a side impact test.
Figure 14B:
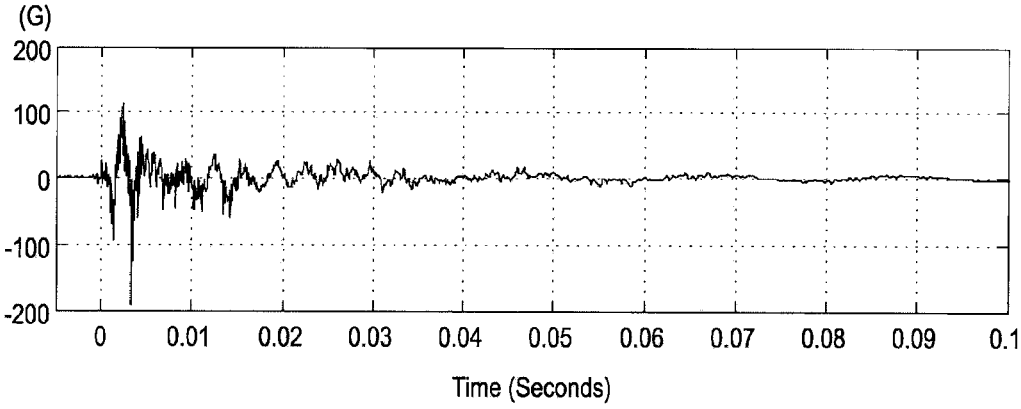
FIG. 14B is a graph illustrating shock absorption data for a trekking pole assembly without any shock absorbing system resulting from a side impact test.

FIGS. 13A and 14A illustrate shock absorption test data for the trekking pole assembly 10. FIGS. 13B and 14B illustrate shock absorption test data for a trekking pole assembly that does not include any shock absorption features (i.e., the shock absorbing member 44 or other feature that is intended to absorb shock forces in the trekking pole assembly). FIGS. 13A-B represent test data from a drop test in which the trekking pole assembly is held vertically upright and dropped to the ground from a predetermined distance. FIGS. 14A-B represent test data from a side impact test in which the trekking pole assembly is help vertically upright and a lateral impact force is applied to the trekking pole assembly.

The test data represented in FIGS. 13A-B and 14A-B is gathered by an accelerometer that is mounted to the handle cover 42 of the handle assembly 14. The graphs shown in FIGS. 13A-B and 14A-B have units of gravity pull (G) on the vertical axis and units of time (seconds) on the horizontal axis.

A comparison of FIGS. 13A and 14A with FIGS. 13B and 14B shows that the trekking pole assembly 10 has significantly greater deceleration (representing increased absorption of shock forces) in a shorter amount of time as compared to a trekking pole assembly without shock absorbing features.

The preceding description has been provided to enable others skilled in the art to best utilize various aspects of the exemplary embodiments described herein. This exemplary description is not intended to be exhaustive or to be limited to any precise form disclosed. Many modifications and variations are possible without departing from the spirit and scope of the instant disclosure. It is desired that the embodiments described herein be considered in all respects illustrative and not restrictive and that reference be made to the appended claims and their equivalents for determining the scope of the instant disclosure.

Unless otherwise noted, the terms "a" or "an," as used in the specification and claims, are to be construed as meaning "at least one of." In addition, for ease of use, the words "including" and "having," as used in the specification and claims, are interchangeable with and have the same meaning as the word "comprising."

What is claimed is:

1. A trekking pole assembly, comprising:
a trekking pole having a proximal end and a distal end;
a handle assembly mounted to the trekking pole, the handle assembly comprising:
a handle housing having a top end, a bottom end, an interior cavity, an opening defined in the bottom end, and at least one lateral opening formed in the handle housing and extending laterally to an exterior of the handle housing;
a shock absorbing member positioned in the interior cavity of the handle housing and interposed between the handle housing and the trekking pole, an expandable portion of the shock absorbing member being positioned between the proximal end of the trekking pole and the handle housing, the expandable portion being at least partially displaceable laterally through the at least one lateral opening upon longitudinal movement of the trekking pole relative to the handle housing.

2. The trekking pole assembly of claim 1, wherein the handle assembly further comprises a handle cover mounted to an exterior of the handle housing.

3. The trekking pole assembly of claim 1, further comprising a plug inserted into an open proximal end of the trekking pole, the plug including a pin aperture, and an attachment pin that extends through the pin aperture and into the handle housing, the attachment pin being configured to connect the plug to the handle housing.

4. The trekking pole assembly of claim 3, further comprising a fastener, wherein the handle housing includes a housing pin aperture and a pin access opening, wherein the attachment pin extends through the pin aperture and the housing pin aperture, and the fastener is insertable through the pin access opening and mounted to the attachment pin to retain the attachment pin to the handle housing.

5. The trekking pole assembly of claim 4, wherein the handle housing includes a dividing wall that defines upper and lower cavities in the handle housing, the housing pin aperture being defined in the dividing wall, and the at least one lateral opening is open to the lower cavity.

6. The trekking pole assembly of claim 1, wherein the shock absorbing member includes a sleeve portion and an expandable portion, the sleeve portion extending along at least a portion of a length of the trekking pole, and the expandable portion being positioned between the proximal end of the trekking pole and the handle housing.

7. The trekking pole assembly of claim 6, wherein the expandable portion is configured to move through the at least one lateral opening in the handle housing upon relative longitudinal movement between the trekking pole and handle housing.

8. The trekking pole assembly of claim 6, wherein the sleeve portion includes a plurality of longitudinally arranged ribs in contact with the trekking pole.

9. The trekking pole assembly of claim 1, wherein the handle housing includes a dividing wall that defines upper and lower cavities, the shock absorbing member being positioned in the lower cavity.

10. The trekking pole assembly of claim 1, wherein the shock absorbing member comprises a gel material.

11. The trekking pole assembly of claim 1, wherein at least a portion of the shock absorbing member is displaceable longitudinally upon longitudinal movement of the trekking pole relative to the handle housing.

12. The trekking pole assembly of claim 1, wherein the at least one lateral opening is positioned radially adjacent to the portion of the shock absorbing member.

13. The trekking pole assembly of claim 1, wherein the at least one lateral opening is positioned at the bottom end of the handle housing.

14. The trekking pole assembly of claim 1, wherein a thickness of the portion of the shock absorbing member is greater than a thickness of a longitudinal portion of the shock absorbing member extending distal of the proximal end of the trekking pole.

15. A handle shock absorbing system, comprising:
a handle member having a first open end, a second closed end, and a plurality of lateral openings extending laterally to an exterior of the handle member, the handle member being configured to receive a proximal end of a trekking pole;
a shock absorbing member having a plurality of expandable portions thereof positioned in the handle member between the second closed end and the proximal end of the trekking pole and configured to expand laterally out of the lateral openings upon application of a longitudinal force to the shock absorbing member.

16. The handle shock absorbing system of claim 15, further comprising an attachment pin configured to connect the handle member to a trekking pole.

17. The handle shock absorbing system of claim 16, wherein the attachment pin extends through a pin aperture in the handle member and through the shock absorbing member.

18. The handle shock absorbing system of claim 16, further comprising a plug insertable into the trekking pole, wherein the attachment pin extends through the plug and through a pin aperture of the handle member.

19. The handle shock absorbing system of claim 15, wherein at least a portion of the shock absorbing member is displaceable longitudinally upon application of a longitudinal force to the shock absorbing member with the proximal end of the trekking pole.

* * * * *